United States Patent [19]

Northman

[11] Patent Number: 4,496,101

[45] Date of Patent: Jan. 29, 1985

[54] ULTRASONIC METERING DEVICE AND HOUSING ASSEMBLY

[75] Inventor: Bradley L. Northman, Oak Park, Mich.

[73] Assignee: Eaton Corporation, Cleveland, Ohio

[21] Appl. No.: 387,388

[22] Filed: Jun. 11, 1982

[51] Int. Cl.[3] ..... B05B 3/14

[52] U.S. Cl. ..... 239/102; 239/600; 310/323

[58] Field of Search ..... 239/4, 102, 600; 285/298, 302; 261/DIG. 48; 310/323

[56] References Cited

U.S. PATENT DOCUMENTS

| | | | |
|---|---|---|---|
| 2,949,900 | 8/1960 | Bodine | 239/102 X |
| 3,103,310 | 9/1963 | Lang | 239/4 |
| 3,121,534 | 2/1964 | Wilson | 239/102 |
| 3,214,101 | 10/1965 | Perron | 239/102 |
| 4,000,852 | 1/1977 | Martin | 239/102 |
| 4,052,004 | 10/1977 | Martin et al. | 239/102 |
| 4,067,496 | 1/1978 | Martin | 239/102 |
| 4,165,961 | 8/1979 | Yamamoto et al. | 239/102 X |
| 4,242,056 | 12/1980 | Dyhr et al. | 285/302 X |
| 4,251,031 | 2/1981 | Martin et al. | 239/102 |
| 4,290,074 | 9/1981 | Royer | 310/323 X |

FOREIGN PATENT DOCUMENTS

| | | | |
|---|---|---|---|
| 2734818 | 2/1978 | Fed. Rep. of Germany | 239/102 |

*Primary Examiner*—Andres Kashnikow

*Attorney, Agent, or Firm*—C. H. Grace; P. S. Rulon

[57] ABSTRACT

Two embodiments of fuel injectors assemblies 10, 100 are disclosed. Injector (10) includes a fluid metering device (12) and a protective housing assembly (14). Device (12) includes an acoustic horn or nozzle assembly (16), a piezoelectric crystal (18) to longitudinally vibrate the nozzle, and a fuel inlet tube (20) rigidly fixed at one end (20*a*) to the nozzle and extending at the other end (20*b*) along an axis parallel to and radially spaced from the longitudinal axis of the nozzle. The protective housing assembly includes O-rings (52, 66) which vibrationally insulate device (12) from the housing and a fuel inlet 44 having a portion (44*c*) telescopically receiving tube end (20*b*) with an annular space therebetween. An O-ring (48) seals the annular space and allows relatively loss free longitudinal and radial movement of tube end (20*b*).

6 Claims, 5 Drawing Figures

ULTRASONIC METERING DEVICE AND HOUSING ASSEMBLY

FIELD OF THE INVENTION

This invention relates to fluid metering devices vibrated to atomize and meter liquid fuel and, in particular, to mounting of such devices in nonvibrated housing.

BACKGROUND OF THE INVENTION

It is well-known in the prior art that liquids may be atomized by vibrating a nozzle often referred to as an acoustic horn. Such nozzles are often vibrated in their longitudinal direction by piezoelectric crystals in response to electrical signals in the 60 KHz range. Such nozzles may or may not include a valve mechanism to control the rate of liquid flow. Valveless versions of such nozzles, as shown in U.S. Pat. Nos. 3,103,310; 3,121,534; and 3,214,101 to Lang, Watson, and Perron respectively, atomize a liquid in response to amplified vibrations of an orifice or opening at the discharge end of the nozzle; flow rate is controlled by other means. Such nozzles with valve mechanisms, as shown in U.S. Pat. Nos. 4,000,852 and 4,067,496 to Martin, additionally control the flow rate of a fuel with a valving member which opens and closes the orifice in response to the amplified vibrations.

Further, it is well-known in the prior art that such nozzles should be vibrationally insulated to reduce or minimize energy losses from the vibrating nozzle to its mounting or interface with nonvibrating means. Lang and Perron in the above mentioned patents disclose chuck-type mounts having three rigid, circumferentially arrayed, centering screws which embrace or hold the nozzles in so-called nodal planes, i.e., nonvibrating planes oriented normal to the longitudinal axes of the nozzles. The screws in the Perron chuck loosely embrace the nozzle to allow radial vibration of the nozzle due to or in accordance with Poissons ratio. Martin et al, in additional U.S. Pat. Nos. 4,052,004 and 4,251,031, teaches that it is difficult in practice to accurately determine vibrational nodes of such nozzles. The Martin et al patents disclose the use of resilient mounts (rubber O-rings) supporting the body portions of the nozzles in protective housings. The resilient mounts embrace the nozzles close to nodal planes normal to the longitudinal axes of the nozzles and yield in response to both longitudinal and radial vibrations, thereby avoiding or reducing the need to accurately determine vibrational nodes.

The Martin et al patent '031 further discloses the feature of dispensing with a metal fuel inlet tube rigidly connected at one end directly to the nozzle and connected at the other end to a somewhat flexible tube on the outside of the housing. While the particular structural arrangement disclosed in the '031 patent may have certain disadvantages, the basic concept of dispensing with the metal inlet tube extending out of the protective housing is advantageous with respect to structural damage vulnerability of the tube and with respect to inherent energy losses to the somewhat flexible tube, particularly wide variations in energy losses due to inadvertent misalignment of the rigid and somewhat flexible tube during factory installation or during field maintenance. Inadvertent misalignment not only affects energy losses but further causes wide variations in the amount of fuel metered by each nozzle for a given electrical energy input to the piezoelectric crystal.

SUMMARY OF THE INVENTION

An object of this invention is to provide an improved fluid inlet for a vibrating nozzle disposed within a protective housing.

According to a feature of the invention, a fluid injector includes a nozzle assembly having a longitudinal axis, a longitudinally extending passage, and means at one end of the nozzle for discharging fluid from the passage; means at the other end of the nozzle to longitudinally vibrate the nozzle; a protective housing assembly containing the other end of the nozzle and the vibrating means and having the discharge end extending therefrom; and a fluid inlet defined by housing assembly. The improvement comprises passage means disposed within the housing for communicating pressurized fluid from the fluid inlet to the longitudinally extending passage, the passage means having at least one end disposed along an axis substantially parallel to the longitudinal axis and moveable relative to one of the assemblies.

BRIEF DESCRIPTION OF THE DRAWINGS

A fluid metering device disposed in a protective housing assembly is illustrated in the accompanying drawings in which.

Figure 1:
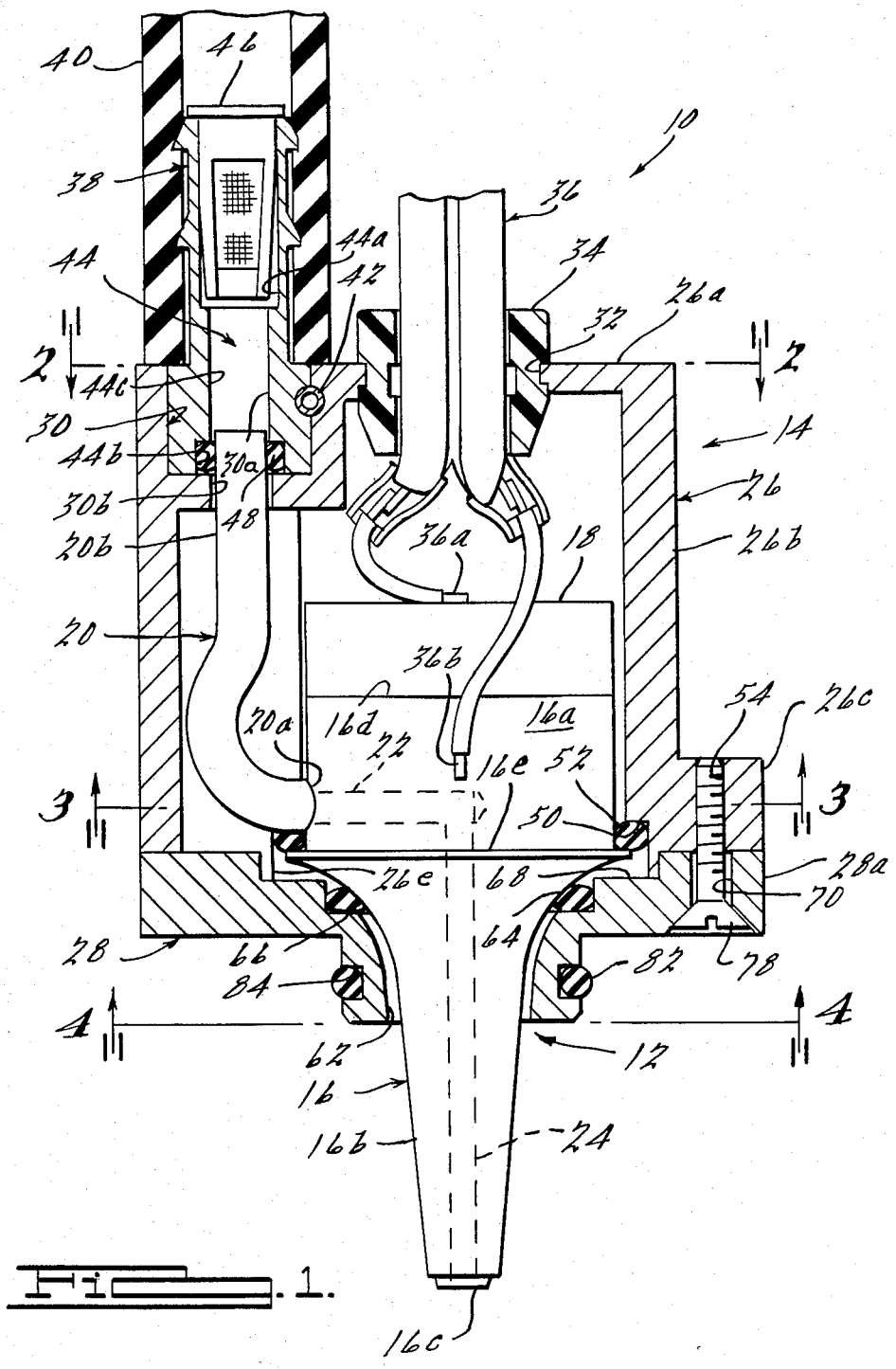
FIG. 1 is a sectional view of the protective housing looking along line 1—1 of FIG. 2 with the metering device in relief.
Figure 2:
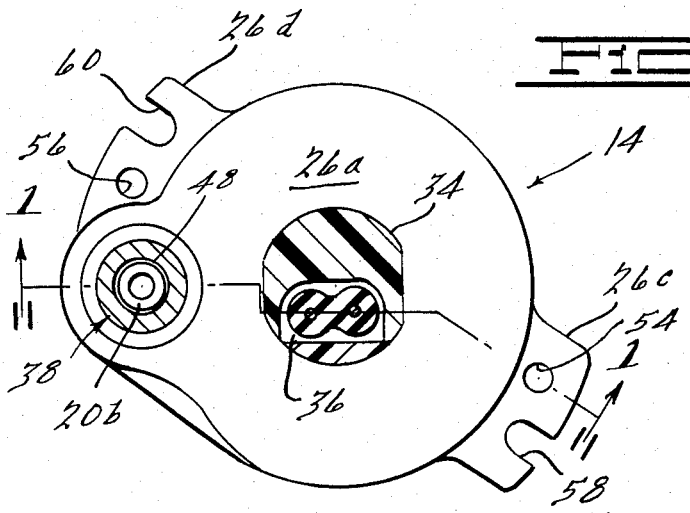
FIG. 2 is an end view of the housing looking along line 2—2 of FIG. 1.
Figure 3:
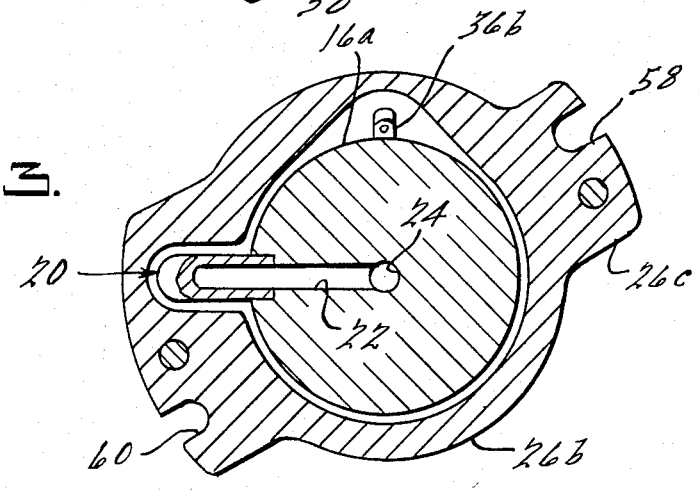
FIG. 3 is a sectional view of the housing and metering device looking along line 3—3 of FIG. 1.
Figure 4:
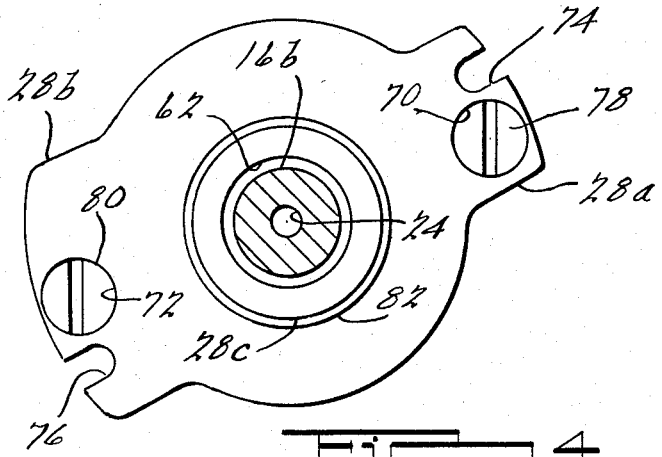
FIG. 4 is a view of the other end of the housing looking along line 4—4 of FIG. 1 with a portion of the metering device in section.

Certain terminology referring to environment, specific types of components, direction, motion, and relationship of components to each other will be used in the following description. This terminology is for convenience in describing the invention and should not be considered limiting unless explicitly used in the claims.

DETAILED DESCRIPTION OF THE DRAWINGS

Looking first at FIGS. 1-4 in general, therein is disclosed an injector assembly 10 including a fluid metering device 12 partly disposed within a protective housing assembly 14. Injector 10 is intended to meter and atomize liquid and preferably liquid fuel to the intake manifold of an Otto cycle engine, not shown. Device 12 includes an acoustic horn or nozzle assembly 16, a vibrational means or piezoelectric crystal 18, a fuel passage or tube 20.

As is well-known in the art, nozzle 16 includes a large or round body portion **16*a* and a tapered or necked down portion 16*b* having a discharge end 16*c* which vibrates at an amplified amplitude in response to longitudinal vibration of body portion 16*a*. Body portion 16*a* includes a round end surface 16*d* having piezoelectric crystal 18 conductively bonded thereto, a radially extending mounting flange 16*e*, and a radially extending fuel passage 22 for communicating tube 20 with a longitudinally extending passage 24. Piezoelectric crystal 18 longitudinally vibrates the nozzle at ultrasonic frequencies in response to electrical signals in the 60 KHz range. Passage 24 may extend all the way to discharge end 16***c* or preferably to an unshown valve mechanism disposed in portion 16*b* adjacent to end 16*c*. The valve mechanism may be of the general type disclosed in previously mentioned U.S. Pat. Nos. 4,000,852 and 4,067,496. An end 20*a* of tube 20 is rigidly fixed to body portion 16*a* via well-known means such as brazing or welding. The other end 20*b* of the tube extends along an axis parallel to the longitudinal axis of the nozzle.

Protective housing assembly 14, which may be cast or molded, includes a cap member 26 and an end member 28. Cap member 26 includes an end portion 26*a* and a circular wall portion 26*b* of irregular shape to accommodate tube 20 and one of two electrical conductors attached to the metering device. End portion 26*a* includes a counterbored opening 30 having major and minor diameters 30*a*, 30*b* and an opening 32 receiving a stress relief grommet 34 retaining a two conductor cable 36 having a hot conductor 36*a* conductively connected to crystal 18 and a ground conductor 36*b* conductively connected to body portion 16*a* of the nozzle. A hose nipple 38 is connected at one end to a rubber fuel inlet hose 40 and is press fitted at the other end into major diameter 30*a* of opening 30. A roll pin 42 locks the nipple in the opening. Nipple 38 includes a fuel inlet passage 44 having an enlarged portion 44*a* for a final or last chance filter 46, a counterbored portion 44*b* for a rubber O-ring seal 48, and a passage portion 44*c* in axial alignment with opening 30*b*. Passage portion 44*c* and opening 30*b* have diameters somewhat larger than end 20*b* of tube 20 for telescopically receiving end 20*b* with a radial or annular space therebetween. O-ring 48 seals the radial or annular space therebetween, allows substantially loss-free axial movement of tube end 20*b* due to longitudinal vibration of nozzle 16, and allows substantially loss-free radial movement of tube end 20*b* due to Poissons ratio.

Wall portion 26*b* of cap member 26 includes a counterbore 50 for an O-ring 52 and two diametrically opposite mounting flanges 26*c*, 26*d* each having a threaded hole 54, 56 and a U-shaped opening 58, 60 for unshown bolts which secure housing assembly 14 to an engine manifold. O-ring 52 functions as a vibrational insulator between the nozzle and housing assemblies and is preferably made of a resilient material such as rubber.

End member 28 includes a central opening 62 having nozzle portion 16*b* extending therethrough, a counterbore 64 for a second O-ring 66, a counterbore 68 receiving an alignment sleeve 26*e* extending axially from cap member 26, two mounting flanges 28*a*, 28*b*, and a sleeve portion 28*c*. Second O-ring 66 seals the space between nozzle portion 16*b* and central opening 62 and further functions as a vibrational insulator between the nozzle and housing assemblies. O-ring 66 is preferably made of a resilient material such as rubber and preferably contacts nozzle portion 16*b* at a node. Each flange 28*a*, 28*b* includes a countersunk opening 70, 72 respectively aligned with a threaded hole 54, 56 and a U-shaped opening 74, 76 respectively aligned with one of the U-shaped openings 58, 60. Countersunk screws 78, 80 secure cap and end members 26, 28 together. Sleeve portion 28*c* is adapted for insertion into an unshown manifold opening which is sealed by an O-ring 82 disposed in an annular groove 84.

Figure 5:
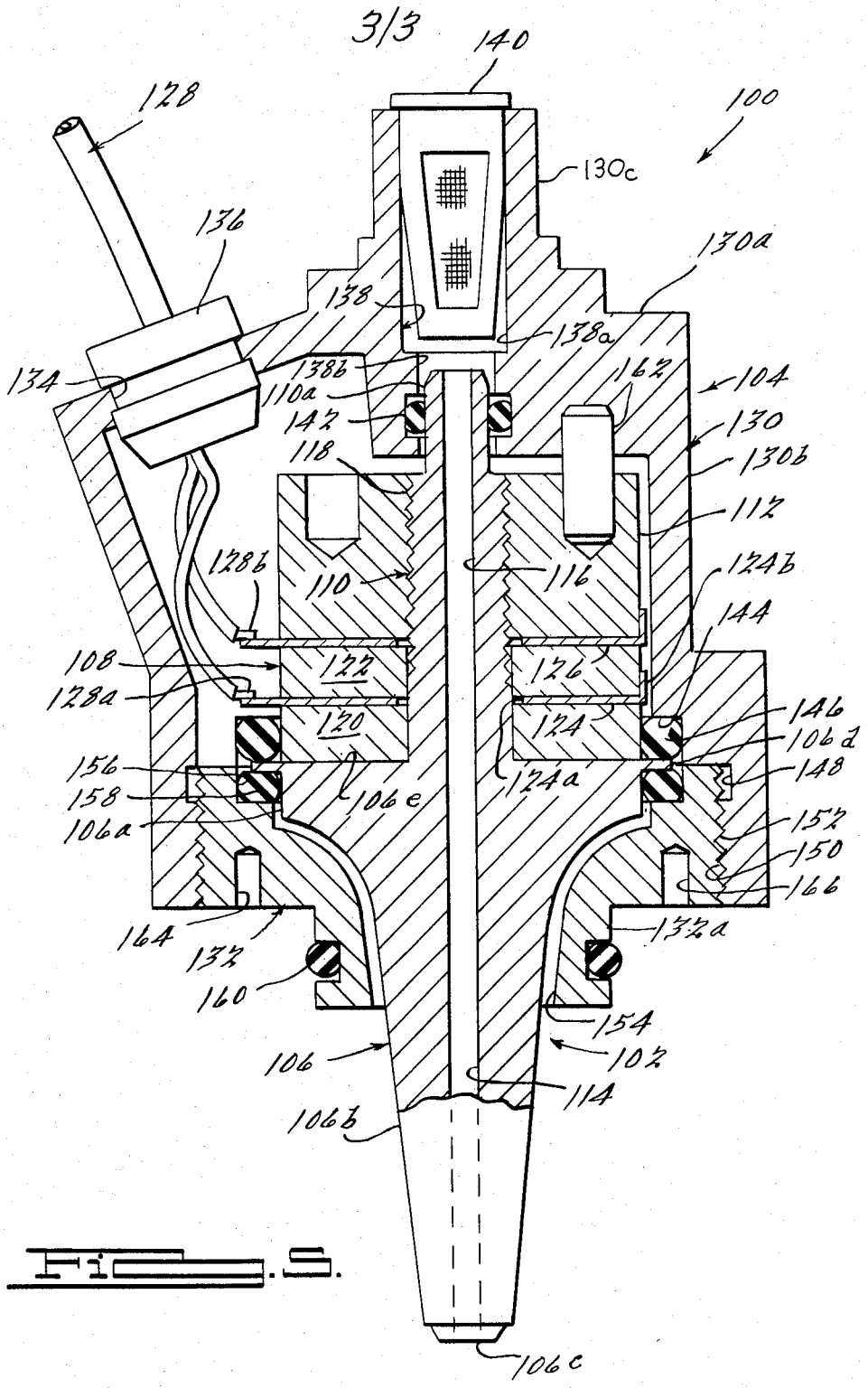
FIG. 5 is a sectional view of another protective housing with a portion of a metering device therein in relief.

Looking now at FIG. 5, therein is disclosed an injector assembly 100 including a fluid metering device 102 disposed with a protective housing assembly 104. Injector 100, like injector 10, is intended to meter and atomize liquid and preferably liquid fuel to the intake manifold of an Otto cycle engine, not shown. Device 102 includes an acoustic horn or nozzle assembly 106, vibrational means or a piezoelectric crystal assembly 108, a fuel inlet passage or tube 110, and a back mass 112.

Nozzle 106 includes a large or body portion 106*a* and a tapered or necked down portion 106*b* having a discharge end 106*c* which vibrates at an amplified amplitude in response to longitudinal vibration of body portion 106*a*. Body portion 106*a* includes an annular mounting flange 106*d* preferably located at a nozzle node, an annular surface 106*e*, and a longitudinally extending passage 114. Passage 114 may extend all the way to discharge end 106*c* or preferably to an unshown and previously mentioned valve mechanism disposed in portion 106*b* adjacent to end 106*c*. Tube 110, which is integrally formed with nozzle 106, includes a passage 116 axially aligned with passage 114, a reduced diameter end portion 110*a*, and a set of helical threads 118. Tube 110 may be formed as a hollow stud secured to nozzle 106 by a threaded or welded connection.

Piezoelectric crystal assembly 108 includes two annular piezoelectric crystals 120, 122 and two relatively thin, annular conductors 124, 126. Conductor 124 includes a central opening 124*a* larger than the central openings in the crystals and a plurality of circumferentially spaced tabs 124*b*. Tabs 124*b* embrace crystal 122 and concentrically align the opening in conductor 124 with the opening in crystal 122 to prevent direct electrical contact between conductor 124 and tube 110. Conductor 124 is electrically connected to a hot conductor 128*a* of a two-conductor cable 128. Conductor 126 is electrically connected to a ground conductor 128*b*. Back mass 114 threads onto tube 110 to firmly sandwich the crystals between annular surface 106*e* and the back mass.

Protective housing assembly 104, which may be cast or molded, includes a cap member 130 and an end member 132. Cap member 130 includes an end portion 130*a* and a somewhat circular wall portion 130*b*. End portion 130*a* includes a tubular extension 130*c* defining a hose nipple and an opening 134 receiving a stress relief grommet 136 retaining cable 128. A fuel inlet passage 138, extending through the nipple and into the housing, includes an enlarged portion 138*a* for a final filter 140 and a portion 138*b* having a diameter somewhat larger than diameter of end portion 110*a* of tube 110. Passage portion 138*b* is axially aligned with passage 116 and telescopically receives end portion 110*a* with a radial or annular space therebetween. An O-ring 142 retained in an annular groove seals the annular space therebetween, allows substantially loss-free axial movement of end portion 110*a* due to longitudinal vibration of nozzle 106, and allows substantially loss-free radial movement of end portion 110*a* due to Poissons ratio. However, since the diameter of end portion 110*a* is relatively small and is axially aligned with the longitudinal axis of nozzle 106, radial movement due to Poissons ratio should be relatively minor.

Wall portion 130*b* of cap member 130 includes a counterbore 144 for an O-ring 146 and counterbore 148 having threads 150 in its cylindrical wall portion. O-ring 146 functions as a vibrational insulator between the nozzle and housing assemblies and is preferably made of a resilient material such as rubber.

End member 132 includes threads 152 which mate with threads 150 for securing the end member in counterbore 148, a central opening 154 having nozzle portion 106*b* extending therethrough, a counterbore 156 for a second O-ring 158, and a sleeve portion 132*a*. O-ring 158 seals the housing assembly and functions as a vibrational insulator between the nozzle and housing assemblies. O-ring 158 is preferably made of a resilient material such as rubber. Sleeve portion 132*a* is adapted for insertion into an unshown manifold opening which is sealed by an O-ring 160 disposed in an annular groove. Rotation of fluid metering device 102 relative to the housing assembly is prevented by a slip fit dowel pin 162.

Housing assembly 104 may be secured to the unshown engine manifold in any of several well-known ways. For example, flanges may be used as disclosed for injector assembly 10 or an unshown fuel inlet rail secured to tubular extension 130*c* may apply a longitudinal force holding the injector assembly against the engine manifold. When an inlet rail is so used, a hole 164 and/or a hole 166 may receive an unshown dowel pin projecting from the manifold to prevent rotation of the housing assembly relative to the manifold.

Two embodiments of the instant invention have been disclosed for illustrative purposes. Many variations and modifications of the disclosed embodiments are believed to be within the spirit of the invention. For example, tubes 20 and 110, which are disclosed as having one end fixed to the nozzle assemblies and the other end moveable relative to the housing assemblies, may have the fixed and moveable ends reversed or may have both ends moveable. The following claims are intended to cover the inventive portions of the disclosed embodiments and variations and modifications believed to be within the spirit of the invention.

What is claimed is:

1. In a fluid injector including an acoustic horn defining a nozzle assembly having a longitudinal axis, a longitudinally extending passage, and means at one end of the nozzle assembly for discharging fluid from the passage; means at the other end of the nozzle assembly for longitudinally vibrating the nozzle assembly; a housing assembly having the discharge end of the nozzle assembly extending therefrom; and a fluid inlet defined by the housing assembly; the improvement comprising:

passage means disposed within the housing assembly for supplying pressurized fluid from the fluid inlet to the longitudinally extending passage, said passage means having at least one end disposed along an axis substantially parallel to the longitudinal axis and moveable relative to at least one of the assemblies;

first and second disk-shaped piezoelectric crystals each having a central opening;

a disk-shaped conductor element sandwiched between said crystals and, said conductor having a central opening somewhat larger than the central openings in said crystals and having means to concentrically orient at least one of the crystal openings with the conductor opening; and fastener means extending through said openings for securing said crystals to the nozzle.

2. The injector of claim 1, wherein said fastener means includes:

a tube disposed along the longitudinal axis and defining said passage means, said tube fixed at one end to the nozzle and having the other end telescopically received by said fluid inlet.

3. The injector of claim 2, wherein said fastener means further includes:

a back mass threadably receiving said tube for sandwiching the crystals against the nozzle.

4. In a fuel injector including an acoustic horn defining a nozzle assembly having a longitudinal axis, a longitudinally extending passage, and means at one end of the nozzle assembly for discharging fuel therefrom; means at the other end of the nozzle assembly for ultrasonically vibrating the nozzle assembly to effect the fuel discharge; a housing assembly having the one end of the nozzle assembly extending therefrom; a fuel inlet passage defined by the housing assembly; the improvement comprising:

passage means disposed within the housing assembly for supplying pressured fuel from the fuel inlet to the longitudinally extending passage, said passage means having at least one end disposed along an axis substantially parallel to the longitudinal axis and moveable relative to at least one of the assemblies;

first and second disk-shaped piezoelectric crystals each having a central opening;

a disk-shaped conductor element sandwiched between said crystals and, said conductor having a central opening somewhat larger than the central openings in said crystals and having means to concentrically orient at least one of the crystal openings with the conductor opening; and fastener means extending through said openings for securing said crystals to the nozzle.

5. The injector of claim 4, wherein said fastener means includes:

a tube disposed along the longitudinal axis and defining said passage means, said tube fixed at one end to the nozzle and having the other end telescopically received by said fluid inlet.

6. The injector of claim 5, wherein said fastener means further includes:

a back mass threadably receiving said tube for sandwiching the crystals against the nozzle.

* * * * *